United States Patent [19]

Bloom

[11] 4,432,454

[45] Feb. 21, 1984

[54] COMPARTMENTALIZED DOCUMENT CARRIER CARTON

[76] Inventor: Otis J. Bloom, 478 Richmond Dr., Millbrae, Calif. 94030

[21] Appl. No.: 420,029

[22] Filed: Sep. 20, 1982

[51] Int. Cl.[3] ..... B65D 5/48; B65D 85/00

[52] U.S. Cl. ..... 206/425; 206/44 B; 206/45.19; 206/45.26; 206/449; 229/27; 229/42

[58] Field of Search ..... 206/44 B, 45.11, 45.12, 206/45.19, 45.26, 425, 449, 193; 229/15, 27, 28, 42

[56] References Cited

U.S. PATENT DOCUMENTS

| | | | |
|---|---|---|---|
| 1,464,182 | 8/1923 | Levigton | 229/15 |
| 2,587,706 | 3/1952 | Deline | 229/15 |
| 2,670,123 | 2/1954 | Frankenstein | 229/27 |
| 2,796,213 | 6/1957 | Shanahan | 229/42 |
| 2,797,855 | 7/1957 | Moore | 229/42 |
| 2,964,230 | 12/1960 | Nemoede | 229/28 R |
| 3,138,283 | 6/1964 | Peebles | 229/42 |
| 3,945,557 | 3/1976 | Graham, Jr. | 229/15 |
| 3,971,468 | 7/1976 | Helms et al. | 206/193 |

FOREIGN PATENT DOCUMENTS

| | | | |
|---|---|---|---|
| 97555 | 11/1961 | Denmark | 229/42 |
| 2498562 | 7/1982 | France | 229/15 |
| 190845 | 8/1964 | Sweden | 229/15 |

*Primary Examiner*—William T. Dixson, Jr.
*Assistant Examiner*—Brenda J. Ehrhardt
*Attorney, Agent, or Firm*—Robert W. Dilts

[57] ABSTRACT

A document carrier carton is disclosed which is adapted to provide variable size compartments for the transportation of bank drafts and checks in pre-arranged order with reduced likelihood of damage to the bank drafts or checks. The carton or insert for a carton includes a bottom wall having a plurality of U-shaped slits defining upwardly bendable partitions and side walls having U-shaped slits defining inwardly bendable spaced abutment members for holding the partition members in an erected position. In use, one of the partition members and the abutment members associated therewith are erected to provide a compartment of suitable size to contain a quantity of bank drafts or checks under compression. The partitions and abutment members are designed to provide sufficient physical strength to contain a substantial range in quantity of bank drafts and checks under a substantial range of compressive force. Specific embodiments of the compartmentalized document carrier carton are disclosed.

10 Claims, 5 Drawing Figures

COMPARTMENTALIZED DOCUMENT CARRIER CARTON

DESCRIPTION

FIELD OF THE INVENTION

This invention relates to cardboard cartons for transporting articles in compartments thereof and more particularly to a reusable carton providing compartments of variable size for transporting paper documents such as bank checks and the like in a desired pre-sorted arrangement.

BACKGROUND OF THE INVENTION

Cardboard cartons for transporting articles of various kinds in a separated state are well known in the art. It is also well known in the art to construct such cartons by providing partitions or separating members which fold out of the plane of the cardboard material of the side or bottom walls in which they are formed. Finally, it is known in the prior art to provide various means for maintaining the partitions in an extended state.

However, the structures known in the prior art are deficient in providing variable size compartments having satisfactory structural strength when one or more is empty. In other words, the cartons are either designed to be transported with all of the compartments therein filled so that the articles being transported contribute to the structural strength of the compartments or they are designed to provide rigidly fixed compartments that cannot be varied in size.

It is the object of this invention to overcome the above and other deficiencies of the prior art.

SUMMARY OF THE INVENTION

A document carrier carton having a bottom wall, a pair of side walls and a pair of end walls according to this invention comprises means forming the interior surface of the bottom wall which includes a plurality of spaced U-shaped slits with the portions of such surface within the slits being bendable upwardly in spaced parallel relation to provide partitions extending parallel to the end walls. The ends of the partitions so formed are spaced from the side walls of the carton. According to this invention, the carton also comprises means forming the interior surfaces of the side walls including a plurality of spaced substantially U-shaped slits with the portions of such surfaces within the slits bendable inwardly in spaced relation to each other in a common plane parallel to the bottom wall of the carton to provide abutment members between the partitions at each end thereof. The document carrier carton according to this invention further comprises means for removably fixing each of the abutment members of one side wall together with a corresponding one of the abutment members of the other side wall in pairs to a different one of the partition members.

BRIEF DESCRIPTION OF THE DRAWING

This invention will be more fully understood from a reading of the following detailed description of preferred embodiments thereof with reference to the attached drawing wherein.

DETAILED DESCRIPTION OF PREFERRED EMBODIMENTS

Figures 1, 5:
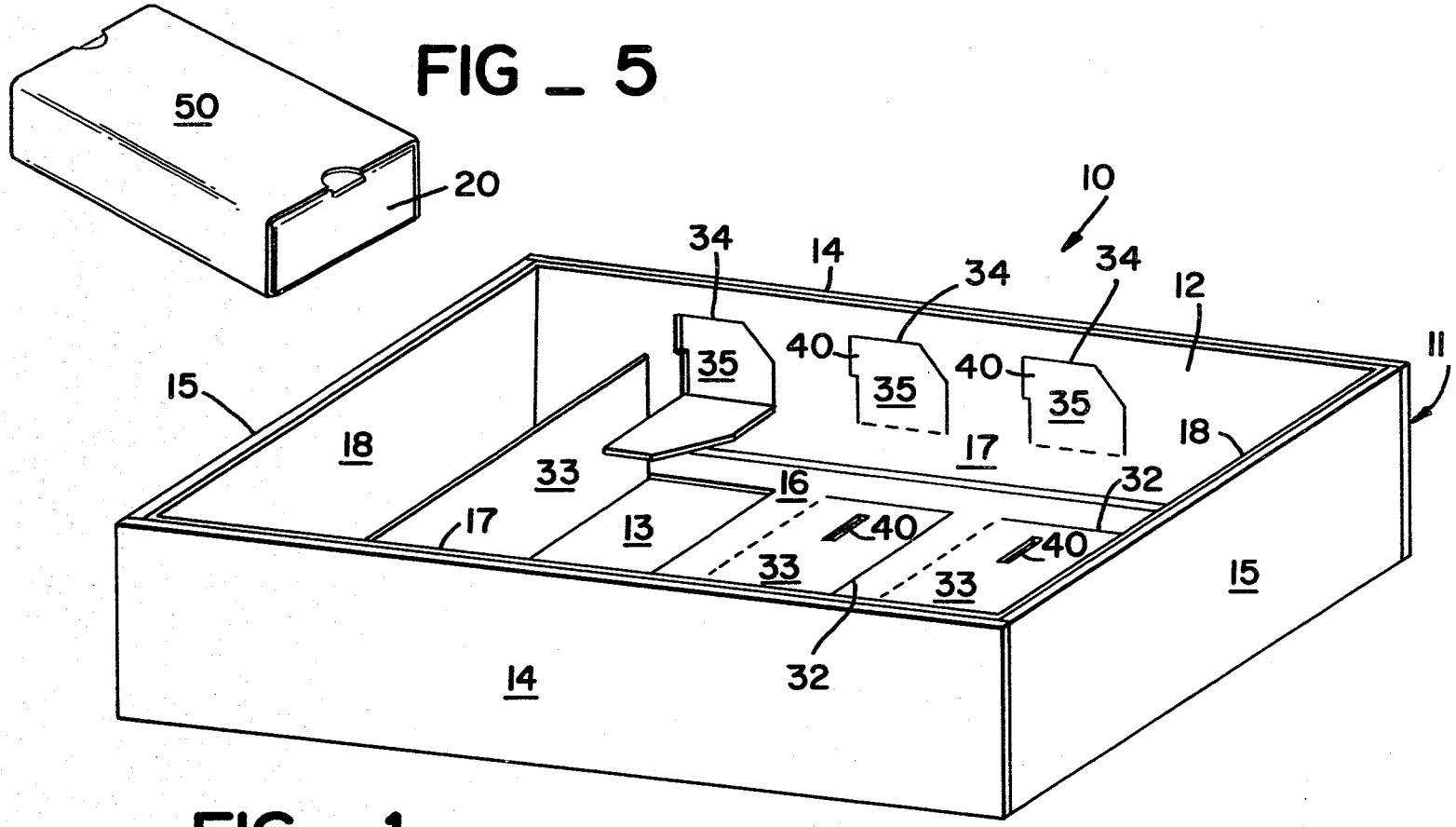
FIG. 1 is a perspective view of an embodiment of this invention wherein a carton having a bottom wall, a pair of side walls and a pair of end walls is provided with an insert in accordance with the teaching of this invention.
FIG. 5 is a reduced perspective view showing a tubular shield or sheath member in use with a carton or a carton having an insert in accordance with the teaching of this invention.

Referring to FIG. 1, a perspective view of an embodiment 10 of this invention comprising a conventional open top box 11 provided with an insert 12 according to this invention is shown. The box 11 includes a bottom wall 13, a pair of side walls 14 and a pair of end walls 15. According to this invention, the insert 12 includes a body part 16 forming the interior surface of the bottom wall 13 of the box 11 as well as a pair of integral side walls 17 which form the interior surfaces of the side walls 14 of the box 11. According to the embodiment 10 of this invention shown in FIG. 1, the insert 12 also includes a pair of integral end walls 18 which form the interior surfaces of the end walls 15 of the box 11. However, such insert end walls 18 are not essential and could be omitted in other embodiments of this invention similar to the embodiment 10.

Figure 2:
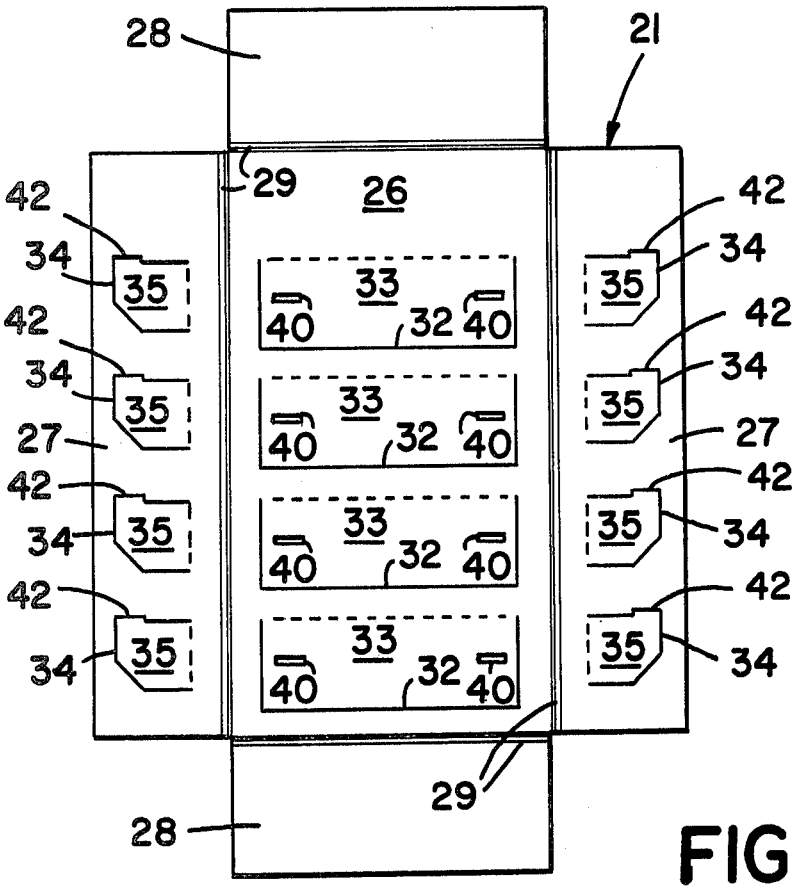
FIG. 2 is a top plan view of a corrugated cardboard blank cut and scored for bending to form a carton or an insert for a carton according to the teaching of this invention.

Referring to FIG. 2, a plan view of a cut and scored blank 21 suitable for use either in forming an insert 12 according to the embodiment 10 of this invention shown in FIG. 1, or in forming an independent box according to the embodiment of this invention 20 which will be more fully discussed in connection with FIG. 5. Thus, the blank 21 includes a main body part 26 with integral side wall flaps 27 and end wall flaps 28. The blank 21 is scored as indicated at 29 to facilitate folding of the side wall flaps 27 and end wall flaps 28 upwardly out of the plane of the paper in order to fit the blank into a box such as the box 11 of FIG. 1. Alternatively, the edges of the side wall flaps may be fixed to the adjacent edges of the end wall flaps 28 in their elevated position to form an independent box as in the embodiment 20 to be discussed in connection with FIG. 5.

According to this invention, the body part 16 of the insert 12 and the corresponding body part 26 of the blank 21 of FIG. 2 are provided with a plurality of U-shaped slits 32 therethrough. According to the embodiments of the invention shown in the drawing, the U-shaped slits 32 define rectangular portions 33 which are bendable upwardly as best shown in FIG. 1 to provide partitions 33 extending parallel to each other and to the end walls 15, 18 and 28. Similarly, the side walls 17 of the insert 12 of the embodiment 10 of FIG. 1 and the side walls 27 of the blank 21 of FIG. 2 are provided with U-shaped slits 34 therethrough with the portions of the side walls within such U-shaped slits 34 being bendable inwardly out of the plane of the side walls 17, 27 in spaced relation to each other in a common plane parallel to the body part 16, 26 to provide abutment members 35 between the partitions 33 as best shown in FIGS. 1, 3 and 4.

According to the teaching of this invention, means are provided for removably fixing the abutment members 35 to the partitions 33. Thus, according to the embodiments of this invention shown in FIGS. 1 and 2, each of the partitions is provided with a pair of slots 40 therethrough positioned to be engaged by an abutment member 35. Similarly, each of the abutment members 35 is provided with a flange or tongue projection 42 adapted to be received in the slots 40 of the partition members 33 when the partitions 33 are in their upright position and the abutment members 35 are folded inwardly parallel to the body part 16, 26.

Figure 3:
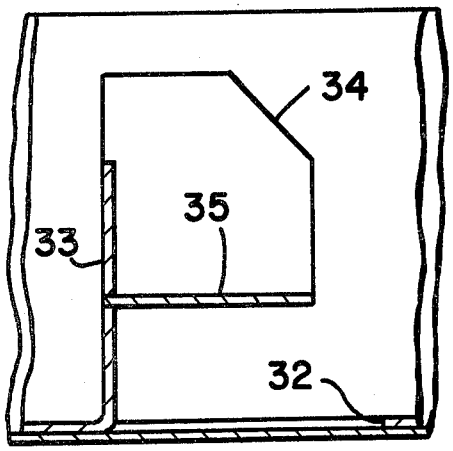
FIGS. 3 and 4 are fragmentary cross-sectional views showing the interrelationship between the partitions and the abutment members according to the teaching of this invention.
Figure 4:
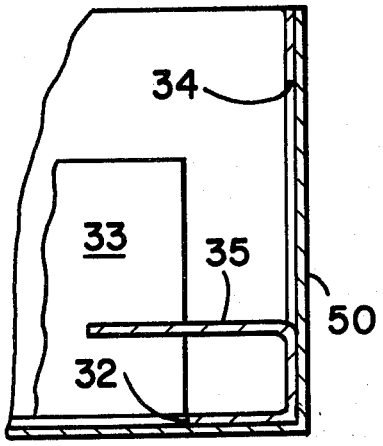

Referring to FIGS. 2, 3 and 4, it will be seen that the folding of the partition members 33 and abutment members 35 into engagement will tend to leave openings through the bottom and sides of the blank 21. Where the blank 21 is formed into a box according to the embodiment 20 of FIG. 5 as distinguished from the insert 12 of the embodiment 10 of this invention shown in FIG. 1, it is desirable to cover such openings. Thus, as best shown in FIG. 5, a tubular shield or sheath 50 of square cross-section dimensioned to receive the box 20 may be used during transport of the box. This sheath 50 could also be used with the box 11 and insert 12 according to the embodiment of this invention as shown in FIG. 1 in order to protect documents contained therein during transport.

According to the preferred embodiment of this invention, the insert 12 of FIG. 1 and the blank 21 of FIG. 2 are preferably made of corrugated cardboard stock commercially available under the designation "200 1C", cut and scored in accordance with the teaching of this invention by methods well known in the art. Although other cardboard stock as well as plastic or other materials might be used, care must be taken to insure that the material used will provide the requisite strength according to the teaching of this invention.

USE IN COMMERCE

In the banking industry, it is necessary to transport large quantities of bank drafts and checks from one bank to another and between branches of the same bank. With the advent of computers and electronic bookkeeping, almost all bank drafts and checks in use today include machine readable numerals usually along the bottom edge thereof. Thus, in transporting bank drafts and checks between banks and branches thereof, it is necessary not only to maintain the checks in a pre-sorted arrangement but also to protect the checks from damage due to bending or creasing during transport which would interfere with the machine readability of the numerals at the lower edges of the bank drafts or checks.

The quantities of bank drafts or checks to be transported between banks or branches thereof vary substantially from shipment to shipment. It is difficult, if not impossible, to design a container capable of maintaining the pre-sorted arrangement of a shipment of checks and at the same time, protect them from deformation regardless of the quantity of checks involved in such shipment. If containers of various sizes are used, then the large size containers will eventually accumulate at the main bank or branch to which large quantities of checks are shipped and small size containers will accumulate at the branches to which small quantities of checks are shipped.

The compartmentalized document carrier carton of this invention is based on the discovery that a given quantity of bank drafts or checks is highly compressible in volume. Thus the thickness and therefore the volume of a stack of several hundred bank drafts or checks may be substantially reduced by the application of sufficient pressure to the major surfaces thereof.

The compartmentalized document carrier carton according to the teaching of this invention is adapted to take advantage of the compressibility of a quantity of bank drafts or checks. Thus, in use, one of the partitions 33 as shown in FIG. 1, for example, would be erected and locked in place by the abutment members 35 to form a relatively small compartment. The construction of the partition member 33 and abutment members 35 according to the teaching of this invention enables the partition 33 to withstand forces exerted between the partition and the adjacent end of the box 11 approaching the forces which the box itself can withstand. Thus, the relatively small compartment can maintain a wide variation in quantity of checks or bank drafts placed therein in pre-sorted arrangement with little danger of damage thereto. In other words, a relatively small quantity of bank drafts or checks may be loosely received in the compartment as well as a very large quantity of checks tightly compressed to make them fit the compartment. When it is desired to transport a quantity of checks which cannot be compressed sufficiently to fit them in the compartment as shown in FIG. 1 of the drawing, the partition 33 shown in its elevated position in FIG. 1 is released from the abutment members 35 and both are folded back into the plane of the body part 16. The next succeeding partition 33 is then elevated and locked into position by the abutment members 35 associated therewith. If the quantity of tightly compressed checks is then placed in the larger compartments so defined, they will expand in volume to fill such compartment with a sufficient compressive interrelationship to maintain them in their presorted arrangement and avoid damage thereto. Thus, the document carrier carton according to the teaching of this invention has been found to be highly versatile in handling the varying quantities of bank drafts or checks which must be shipped between banks or branches thereof with minimum damage thereto. Such versatility is directly dependent on the strength of the compartment formed by erecting a partition 33 and locking it in place with the abutment members 35 according to the teaching of this invention. To this end, the abutment members 35 must have substantial width and the means for removably fixing the abutment members to the partition associated therewith must have substantial strength.

SPECIFIC EMBODIMENT

In an actual embodiment of this invention tested in commerce, a rectangular blank 16⅜ inches wide by 22⅜ inches long made of corrugated cardboard stock commercially available under the trade designation "200 1C" was cut and scored by conventional methods as shown in FIG. 2 to provide a body part 26 having a width of 8⅞ inches and a length of 15 inches. Thus, side wall 27 flaps having a width of 3¾ inches and end wall 28 flaps having a width of 3 11/16 inches were provided. The partition members 33 formed by the U-shaped slits 32 in the body part 26 were 7½ inches long by 2 7/16 inches wide located in equal spaced relation centrally of the body part 26 parallel to each other and to the ends of the blank 21. Thus, if all of the partitions 33 of FIG. 2 were erected at the same time, together with the side wall flaps 27 and end wall flaps 28, five three-inch compartments would be provided. The abutment members 35 provided by the U-shaped slits 34 in the side walls 27 were substantially 2 inches square with one corner of the square at the free end thereof removed for aesthetic purposes. The flanges or tongues 42 were formed at the opposite corner of the free ends of the abutment members 35 and were about ½ inch long projecting substantially the thickness of the cardboard stock. It will be understood that the abutment members 35 on opposite side walls 27 are arranged in pairs each in alignment with a different one of the partitions 33 so that the edge of each abutment member 35 having a projection 42 thereon will lie along the rear surface of such partition 33 when both are erected into operative position. The slots 40 in the partition members 33 are located and dimensioned to receive the flanges or tongues 42 of the abutment members 35 with a close fit to interlock and support the partition members 33.

It is believed that those skilled in the art will make obvious modifications in the embodiment of this invention as described hereinabove and shown in the drawing. For example, the abutment members 35 and slots 40 are located so that the partitions 33 are supported at about their midpoint by the abutment members 35. Such support location could be moved upwardly or downwardly on the partition 33. As shown in the drawing, the abutment members are adapted to fold downwardly out of the plane of the side walls 27 toward the body 26 in which the partitions 33 are formed. Such abutment members 35 could, of course, be adapted to fold upwardly out of the plane of the side walls 27. However, the dimensions and spacings of the partitions 33 and abutment members 35 as shown in the drawing have been found to lie within a fairly narrow range particularly suited to the handling of bank drafts and checks according to the teaching of this invention.

What is claimed is:

1. In a document carrier carton having a bottom wall, a pair of side walls and a pair of end walls, the improvement comprising:

a. means forming the interior surface of said bottom wall including a plurality of spaced U-shaped slits with the portions of said surface within said slits bendable upwardly in spaced parallel relation to provide partitions extending parallel to said end walls, b. means forming the interior surfaces of said side walls including a plurality of spaced substantially U-shaped slits with the portions of said surfaces within said slits bendable inwardly in spaced relation to each other into parallel relation to said bottom wall to provide abutment members between said partitions at each end thereof, and c. means for removably fixing each of said abutment members of one side wall together with a corresponding one of said abutment members of the other side wall in pairs to a different one of said partition members.

2. An insert for a document carrier carton having a bottom wall, a pair of parallel side walls and a pair of parallel end walls interconnected to form a substantially rectangular box, said insert being cut and folded from a single corrugated cardboard blank to form a substantially rectangular body part covering said bottom wall of said carton with integral side walls covering said side walls of said carton, said body part having a plurality of spaced substantially U-shaped slits with the portions of said body part within said slits being bendable upwardly in spaced parallel relation to provide partitions extending parallel to said end walls of said box, said side walls of said insert having a plurality of spaced substantially U-shaped slits with the portions of said side walls of said insert within said slits bendable inwardly in spaced relation to each other into parallel relation to said body part to provide abutment members between said partitions at each end thereof and means removably fixing each of said abutment members of one side wall of said insert together with a corresponding one of said abutment members of the other of said side walls of said insert to a different one of said partition members.

3. A document carrier carton having a bottom wall, a pair of side walls and a pair of end walls, said bottom wall having a plurality of spaced U-shaped slits therethrough with the portions of said bottom wall within said slits being bendable upwardly in spaced parallel relation to define partitions extending parallel to said end walls of said carton, said side walls having a plurality of spaced substantially U-shaped slits therethrough with the portions of said side walls within said slits bendable inwardly in spaced relation to each other into parallel relation to said body part to provide abutment members between said partitions at each end thereof, and means for removably fixing each of said abutment members of one side wall together with a corresponding one of said abutment members of the other of said side walls to a different one of said partitions.

4. The improvement in a document carrier carton as claimed in claim 1 wherein said means for removably fixing each of said abutment members to a different one of said partitions comprises a flange projecting from the side of said abutment member and a slot formed in said partition for receiving said flange with a close fit.

5. The improvement in a document carrier carton as claimed in claim 4 wherein all of said abutment members lie in a common plane parallel to said bottom wall when said flange of each of said abutment members is received in said slot formed in a different one of said partitions.

6. The improvement in a document carrier carton as claimed in claim 4 wherein said partitions extend normally to said bottom wall when said flange of each of said abutment members is received in said slot formed in a different one of said partitions.

7. An insert for a document carrier carton as claimed in claim 2 made of cardboard stock commercially available under type designation "200 1C" wherein each said abutment member has a dimension parallel to said side walls of said carton which is about two inches in length.

8. An insert for a document carrier carton as claimed in claim 7 wherein said means for removably fixing each of said abutment members to a different one of said partitions comprises a flange projecting from about one-half inch of the side of said abutment member having a length about equal to the thickness of said cardboard stock and a slot formed in said partition for receiving said flange with a close fit.

9. The improvement in a document carrier carton as claimed in claim 5 wherein said common plane of said abutment members intersects said partitions at about the middle thereof.

10. The improvement in a document carrier carton as claimed in claim 1 wherein said partitions extend upwardly for a distance less than the height of said side walls and of said end walls of said carton and including an open ended sleeve member dimensioned to receive said carton therewithin with a close fit.

* * * * *